US010159341B1

(12) United States Patent
Thompson et al.

(10) Patent No.: US 10,159,341 B1
(45) Date of Patent: Dec. 25, 2018

(54) SHELVING ASSEMBLY WITH SHELVING DIVIDERS

(71) Applicant: L&P Property Management Company, South Gate, CA (US)

(72) Inventors: Terry W. Thompson, Joplin, MO (US); Robert Talbot, Neosho, MO (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 15/703,370

(22) Filed: Sep. 13, 2017

(51) Int. Cl.
*A47B 57/58* (2006.01)
*A47F 5/00* (2006.01)

(52) U.S. Cl.
CPC ..... *A47B 57/588* (2013.01); *A47F 5/0056* (2013.01)

(58) Field of Classification Search
CPC ..... A47B 57/588; A47F 5/0056
USPC ..... 211/134, 169, 184
See application file for complete search history.

(56) References Cited

U.S. PATENT DOCUMENTS 1,162,298 A * 11/1915 Metcalf ..... A47G 25/0685 211/106
1,839,607 A * 1/1932 Slauson ..... D06F 57/08 211/168
2,805,779 A * 9/1957 Caverley ..... A47J 47/16 211/104
2,933,195 A * 4/1960 Radek ..... A47B 57/58 211/153
3,608,741 A * 9/1971 Schray ..... A47F 5/005 211/184
3,669,278 A * 6/1972 Heroy ..... A47F 5/005 211/184
3,789,778 A * 2/1974 Brand ..... A47F 5/13 108/101
3,978,612 A * 9/1976 Young ..... A47G 7/045 211/96
4,729,485 A * 3/1988 Kulbersh ..... A47F 5/13 211/181.1
4,899,668 A * 2/1990 Valiulis ..... A47B 57/58 108/61
4,905,847 A * 3/1990 Hanson ..... A47B 57/58 211/184
5,437,379 A * 8/1995 Wolf ..... A47F 5/0081 211/169
5,836,097 A 11/1998 Lewis et al.
6,056,131 A * 5/2000 Mowbray ..... D06F 57/12 211/104
7,395,938 B2 7/2008 Merit et al.
7,721,659 B2 5/2010 Fast

* cited by examiner

*Primary Examiner* — Ko H Chan
(74) *Attorney, Agent, or Firm* — Barta, Jones & Foley, P.C.

(57) ABSTRACT

A shelving divider includes a base plate having a main body with apertures, and a lip extending from the main body. The shelving divider further includes a center arm coupled to the base plate, a first side arm rotatably coupled to the center arm, and a second side arm rotatably coupled to the center arm.

21 Claims, 10 Drawing Sheets

SHELVING ASSEMBLY WITH SHELVING DIVIDERS

FIELD OF THE INVENTION

The present disclosure relates to the field of shelving assemblies. Specifically, the present disclosure relates to a shelving assembly with shelving dividers.

BACKGROUND

Shelving assemblies are commonly used in, although not limited to, stores, warehouses, and other commercial establishments to display or store consumer products or other articles. Shelving assemblies sometimes include one or more shelving dividers to divide a shelf space into multiple regions.

SUMMARY

In accordance with one embodiment, a shelving divider includes a base plate having a main body with apertures, and a lip extending from the main body. The shelving divider further includes a center arm coupled to the base plate, a first side arm rotatably coupled to the center arm, and a second side arm rotatably coupled to the center arm.

In accordance with another embodiment, a shelving divider includes a base plate, a center arm fixed to the base plate, a first side arm rotatable relative to the center arm, and a second side arm rotatable relative to the center arm. The shelving divider is adjustable between a first configuration where the first side arm extends perpendicular to the center arm and the second side arm extends parallel to the center arm, a second configuration where the first side arm extends parallel to the center arm and the second side arm extends perpendicular to the center arm, and a third configuration where both the first and second side arms extend perpendicular to the center arm Other aspects of the disclosure will become apparent by consideration of the detailed description and accompanying drawings.

Figure 1:
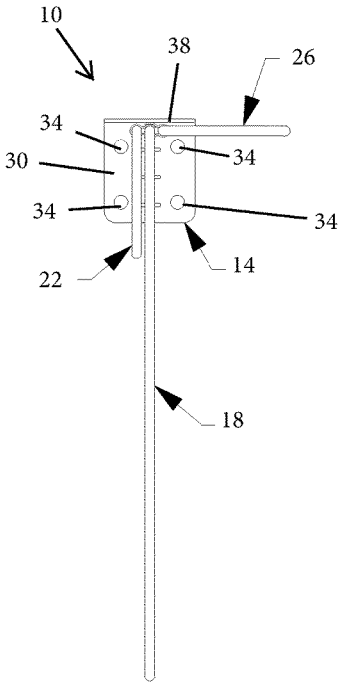
FIG. 1 is a top view of a shelving divider according to one embodiment, the shelving divider illustrated in a first configuration.

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways. Also, it is to be understood that the phraseology and terminology used herein is for the purpose of description and should not be regarded as limited.

DETAILED DESCRIPTION

FIGS. 1-12 illustrate a shelving divider 10. The shelving divider 10 is adjustable between various configurations. Depending upon the chosen configuration, the shelving divider 10 may be used to divide a shelf space into multiple regions, may be used as a shelf end on a first end of a shelf, or may be used as a shelf end on a second, opposite end of the shelf. As illustrated in FIGS. 1-12, the shelving divider 10 includes a base plate 14, a center arm 18 coupled to the base plate 14, a first side arm 22 rotatably coupled to the center arm 18, and a second side arm 26 rotatably coupled to the center arm 18.

The base plate 14 includes a main body portion 30 having four apertures 34 extending therethrough. The main body portion 30 is generally rectangular, although other embodiments include different profiles than that shown (e.g., circular, trapezoidal, etc.), as well as different numbers of apertures 34 than that shown (e.g., one, two, three, five, six, seven, eight, etc.) and different locations and patterns of apertures 34 than that shown. The base plate 14 includes a raised lip 38 extending from one end of the main body portion 30. Some embodiments do not include a raised lip 38, or include more than one raised lip 38, or include a raised lip or lips 38 having profiles other than that illustrated. In the illustrated embodiment the base plate 14 is made entirely from metal, although other embodiments include base plates 14 made only partially of metal or made entirely of a non-metal material (e.g., plastic, etc.).

With continued reference to FIGS. 1-12, a portion of the center arm 18 is coupled (e.g., welded) to the base plate 14 between the four apertures 34, with a remaining portion of the center arm 18 extending away from the base plate 14. The center arm 18 is in the form of an elongate metal wire frame. In other embodiments the center arm 18 is in the form of a thin plate or other elongate structure, and/or a structure made only partially of metal or entirely of a non-metal material (e.g., plastic, etc.). The center arm 18 has a generally trapezoidal profile, although other embodiments include different profiles than that shown (e.g., square, rectangular, triangular, etc.).

Figure 4:
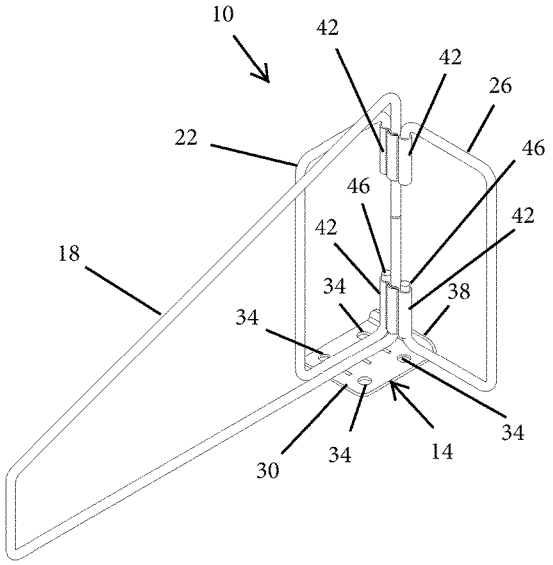
FIG. 4 is a perspective view of the shelving divider in the first configuration.
Figure 2:
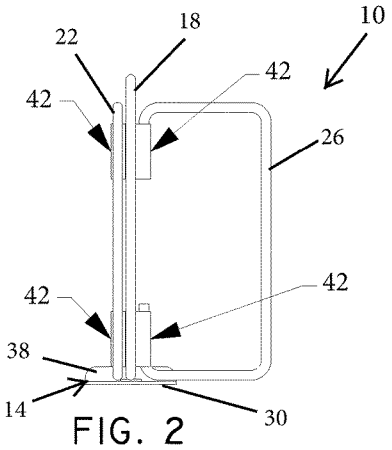
FIG. 2 is a front view of the shelving divider in the first configuration.
Figure 3:
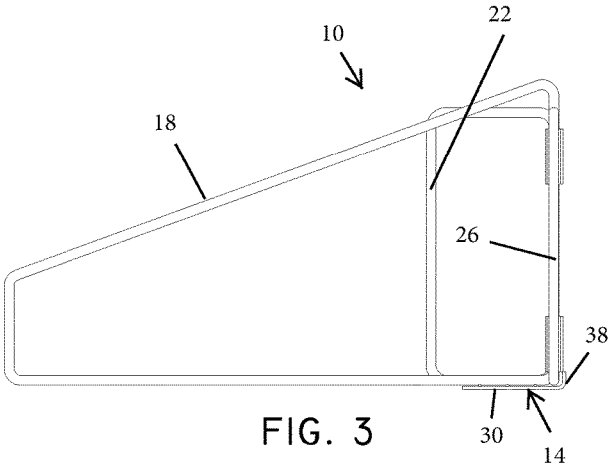
FIG. 3 is a side view of the shelving divider in the first configuration.
Figure 5:
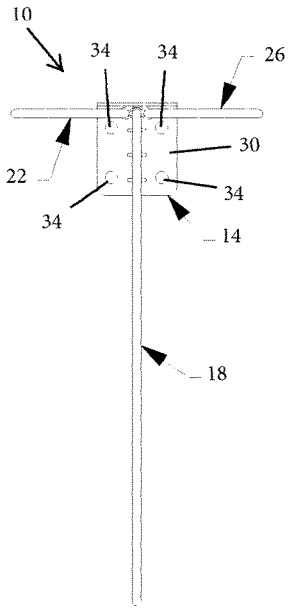
FIG. 5 is a top view of the shelving divider of FIG. 1, the shelving divider illustrated in a second configuration.
Figure 8:
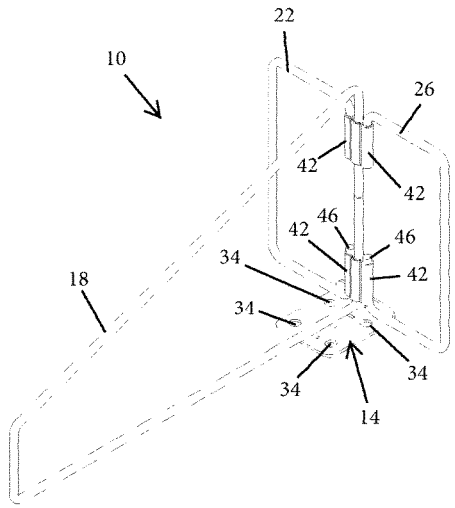
FIG. 8 is a perspective view of the shelving divider in the second configuration.
Figure 6:
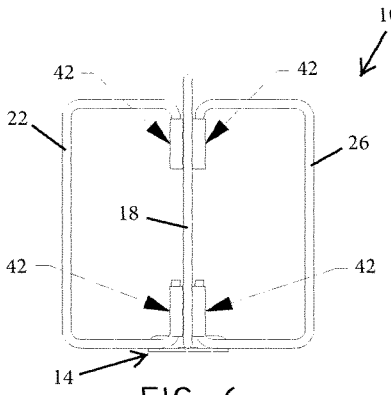
FIG. 6 is a front view of the shelving divider in the second configuration.
Figure 7:
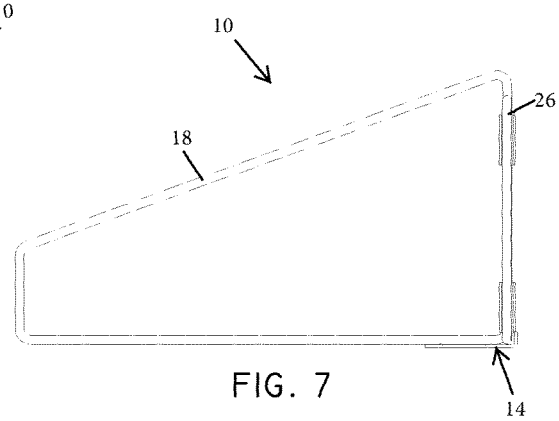
FIG. 7 is a side view of the shelving divider in the second configuration.
Figure 9:
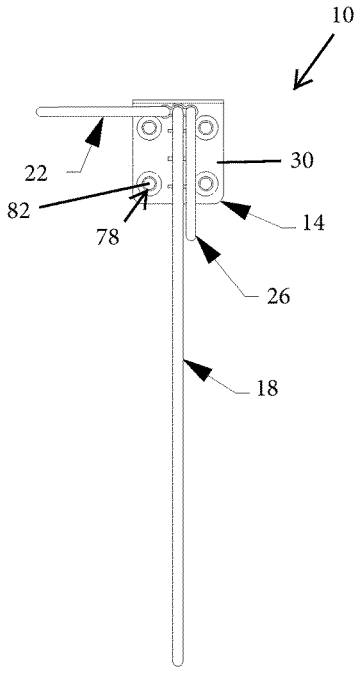
FIG. 9 is a top view of the shelving divider of FIG. 1, the shelving divider illustrated in a third configuration.
Figure 12:
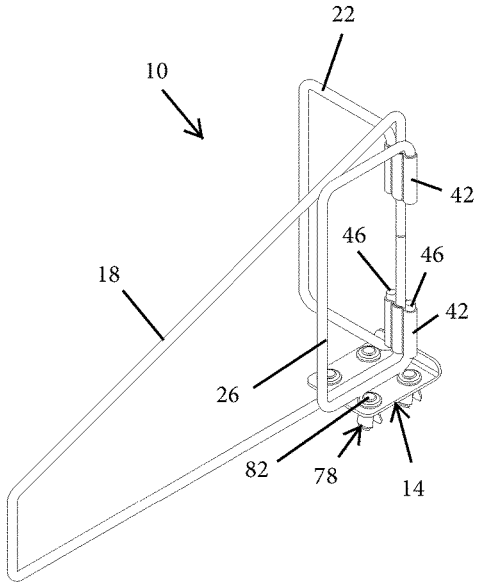
FIG. 12 is a perspective view of the shelving divider in the third configuration.
Figure 10:
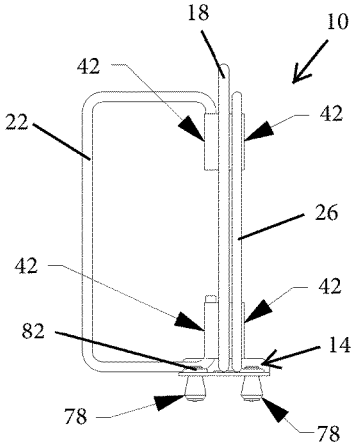
FIG. 10 is a front view of the shelving divider in the third configuration.
Figure 11:
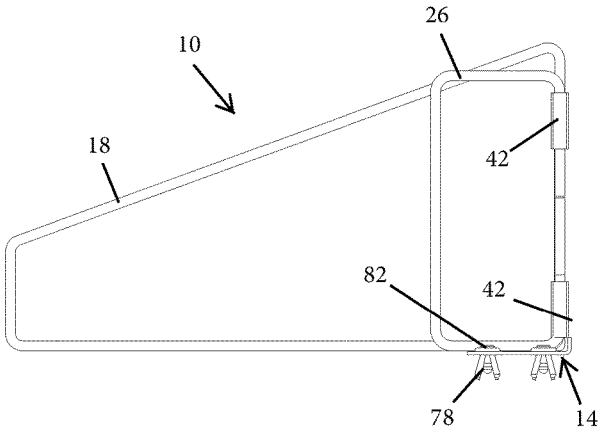
FIG. 11 is a side view of the shelving divider in the third configuration.

With reference to FIGS. 2 and 4, the center arm 18 further includes connectors 42 that couple the first and second side arms 22, 26 to the center arm 18 and permit the first and second side arms 22, 26 to rotate relative to the center arm 18. In the illustrated embodiment, the connectors 42 are open, cylindrical tubes (e.g., metal) that receive ends 46 (e.g., cylindrical ends such as those illustrated in FIG. 4) of the first and second side arms 22, 26. Other embodiments include different types of connectors 42 than that shown (e.g., various types of hinge elements, bearings, etc. that permit rotation of the first and second side arms 22, 26 relative to the center arm 18). In some embodiments, the connectors 42 are disposed on or otherwise form part of the first and second side arms 22, 26, and the center arm 18 includes projections or other structures that are received by the connectors 42 on the first and second side arms 22, 26. In the illustrated embodiment, the first and second side arms 22, 26 are each rotatable up to 90 degrees relative to the center arm 18 between the center arm 18 and the raised lip 38. Other embodiments include different values and ranges of rotation for the first and second side arms 22, 26 (e.g., up to 80 degrees, up to 100 degrees, etc.). The center arm 18 and raised lip 38 also serve to limit rotational travel of the respective arms 22, 26 beyond the aforementioned range.

As illustrated in FIGS. 1-12, the first and second side arms 22, 26 are each in the form of metal wires having a generally rectangular or C-shaped profile, and are equal in size and shape. In other embodiments the first and second side arms 22, 26 are made partially of metal, or entirely of a non-metal material (e.g., plastic). In some embodiments, the side arms 22, 26 are in the form of thin plates or other elongate structures, and/or have other profiles than that shown (e.g., square, rectangular, triangular, etc.). In some embodiments, the first side arm 22 has a different size and/or shape than the second side arm 26.

FIGS. 13-22 illustrate a shelving assembly 54 that includes a shelf 58 and one or more of the shelving dividers 10 described above releasably coupled to the shelf 58. The shelf 58 includes a first end 62, a second opposite end 66, and a main shelf platform 70 that extends between the first end 62 and the second end 66. The main shelf platform 70 is planar, although other embodiments include a non-planar main shelf platform 70, or various main shelf platforms 70 disposed between the first and second ends 62, 66. As illustrated in FIGS. 13-22, the main shelf platform 70 includes apertures 74 (e.g., rows of apertures 74).

Figure 13:
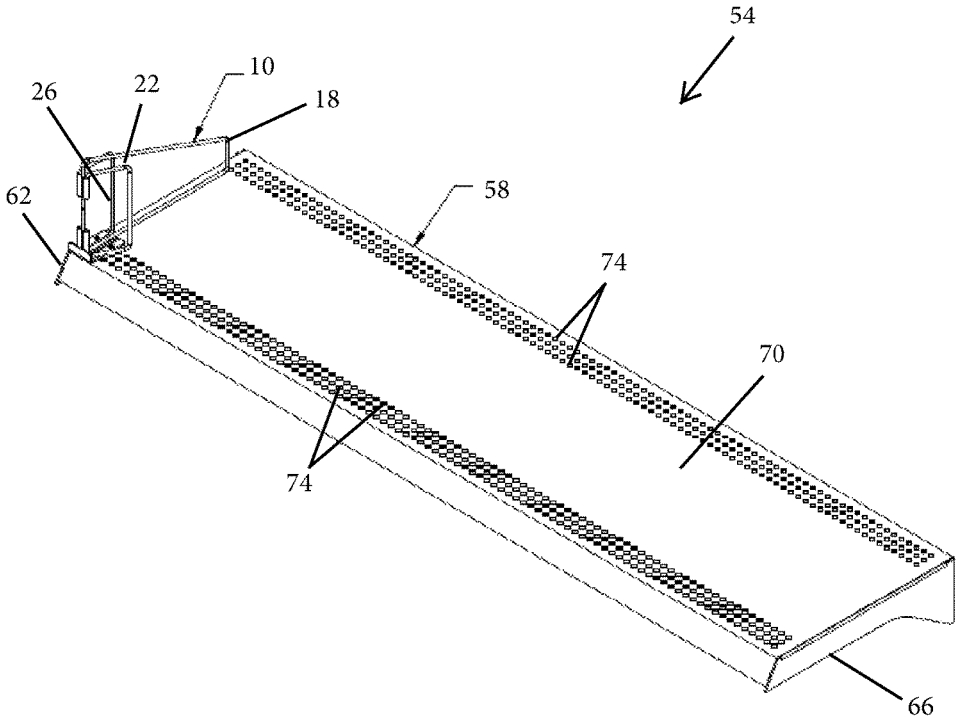
FIG. 13 is a perspective view of a shelving assembly according to one embodiment, the shelving assembly including a shelf and the shelving divider of FIG. 1.
Figure 14:
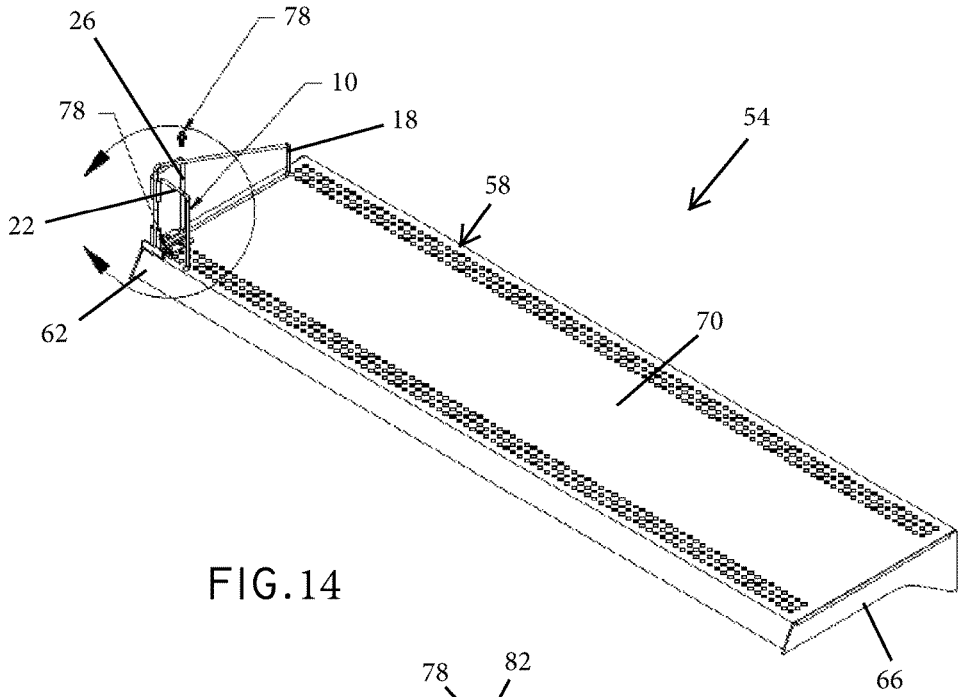
FIGS. 14 and 15 are perspective and enlarged perspective views, respectively, of an assembly process for coupling the shelving divider to the shelf.
Figure 15:
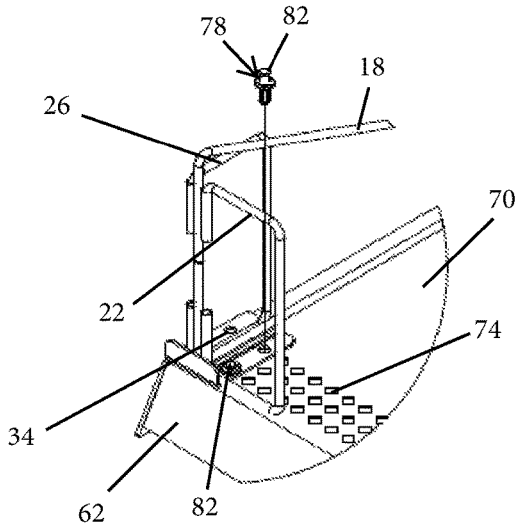

With reference to FIGS. 13-15, one of the shelving dividers 10 may be coupled to the shelf 58 and used as a shelf end on the first end 62 of the shelf 58. To assemble the shelving divider 10 to the shelf 58, the first side arm 22 is rotated away from the center arm 18 until the first side arm 22 extends perpendicular to the center arm 18. The second side arm 26 is rotated toward the center arm 18 such that the second side arm 26 is positioned adjacent the center arm 18 and extends parallel to the center arm 18. The apertures 34 on the main body portion 30 of the base plate 14 are aligned with four of the apertures 74 on the main shelf platform 70 at the first end 62 of the shelf 58. Fasteners 78 (pins, screws, bolts, etc.) are then inserted through the apertures 34, 74 to lock (e.g., releasably lock) the shelving divider 10 to the shelf 58. The fasteners 78 include heads 82. Once the fasteners 78 have been inserted through the apertures 34, 74, the heads 82 block rotation of the first side arm 22 back toward the center arm 18, and block rotation of the second side arm 26 away from the center arm 18. Additionally, the raised lip 38 blocks rotation of the first side arm 22 further away from the center arm 18, and the center arm 18 itself blocks rotation of the second side arm 26 away from the heads 82. Thus, once the fasteners 78 have been inserted, the first and second side arms 22, 26 are rotationally restrained, and as illustrated in FIG. 15 the shelving divider 10 takes the form of a shelf end on the first end 62 of the shelf 58.

Figure 16:
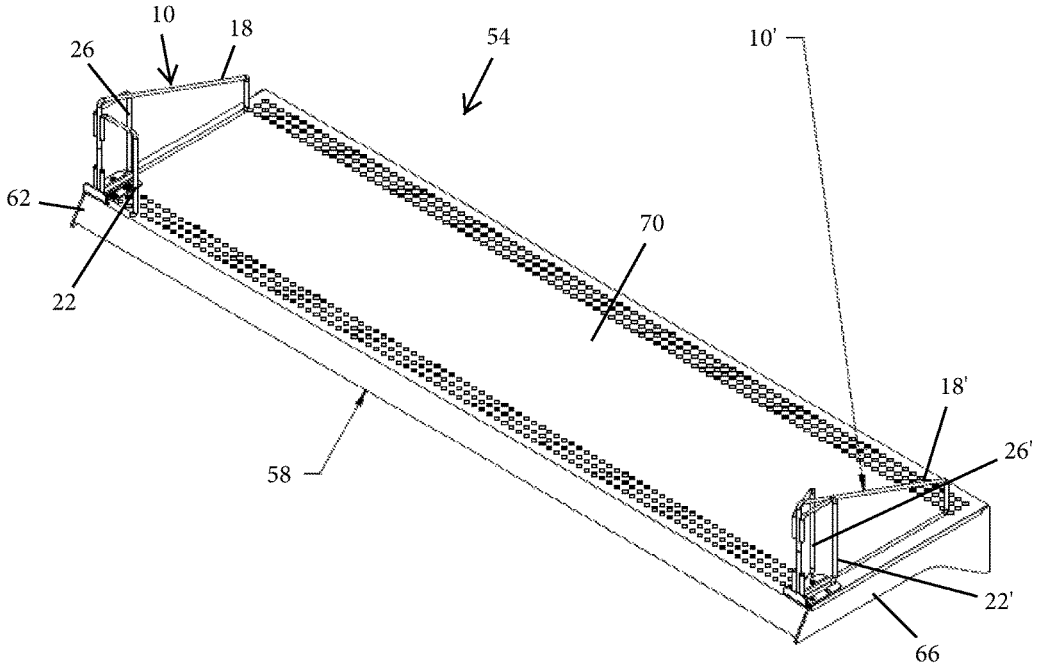
FIG. 16 is a perspective view of the shelving assembly, illustrating a second shelving divider.
Figure 17:
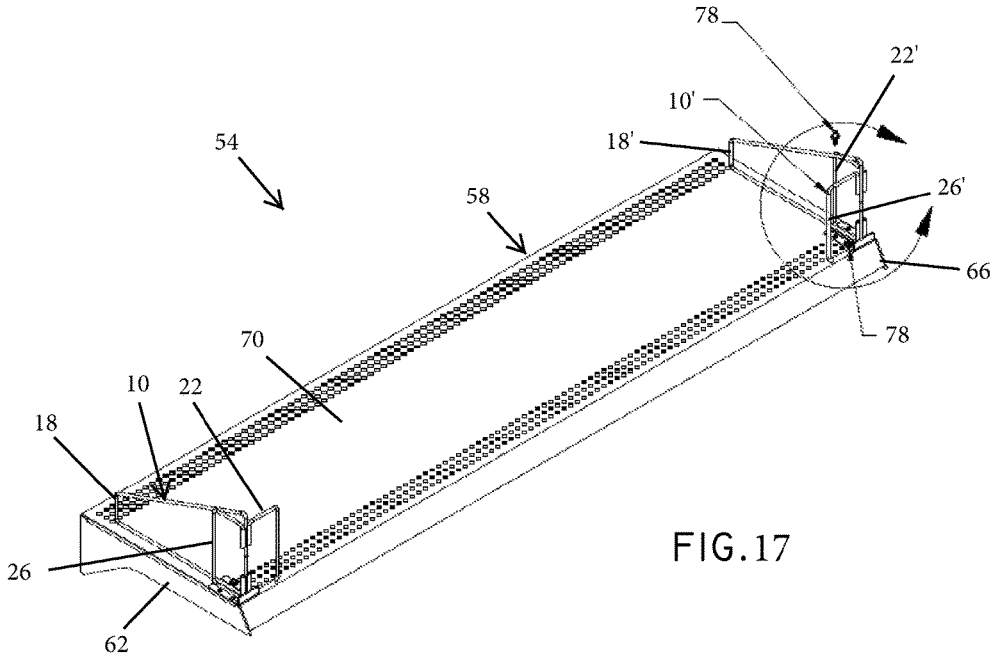
FIGS. 17 and 18 are perspective and enlarged perspective views, respectively, of an assembly process for coupling the second shelving divider to the shelf.
Figure 18:
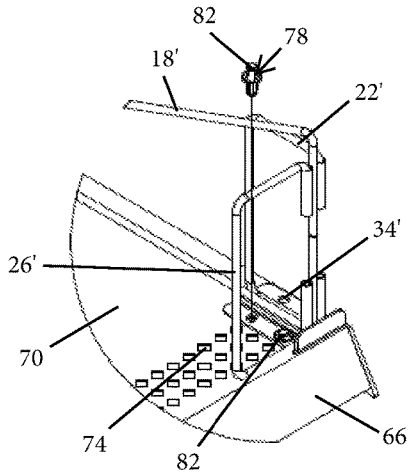

With reference to FIGS. 16-18, another one of the shelving dividers 10 (referenced as 10') may be coupled to the shelf 58 and used a shelf end on the second end 66 of the shelf 58. To assemble the shelving divider 10' to the shelf 58, the second side arm 26' is rotated away from the center arm 18' until the second side arm 26' extends perpendicular to the center arm 18'. The first side arm 22' is rotated toward the center arm 18' such that the first side arm 22 is positioned adjacent the center arm 18' and extends parallel to the center arm 18'. The apertures 34' on the main body portion 30' of the base plate 14' are aligned with four of the apertures 74 on the main shelf platform 70 at the second end 66 of the shelf 58. Fasteners 78 (pins, screws, bolts, etc.) are then inserted through the apertures 34', 74 to lock (e.g., releasably lock) the shelving divider 10' to the shelf 58. As noted above, the fasteners 78 include heads 82. Once the fasteners 78 have been inserted through the apertures 34, 74, the heads 82 block rotation of the second side arm 26' back toward the center arm 18', and block rotation of the first side arm 22' away from the center arm 18'. Additionally, the raised lip 38' blocks rotation of the second side arm 26' further away from the center arm 18', and the center arm 18' itself blocks rotation of the first side arm 22' away from the heads 82. Thus, once the fasteners 78 have been inserted, the first and second side arms 22', 26' are rotationally restrained, and as illustrated in FIG. 18 the shelving divider 10' takes the form of a shelf end on the second end 66 of the shelf 58.

Figure 19:
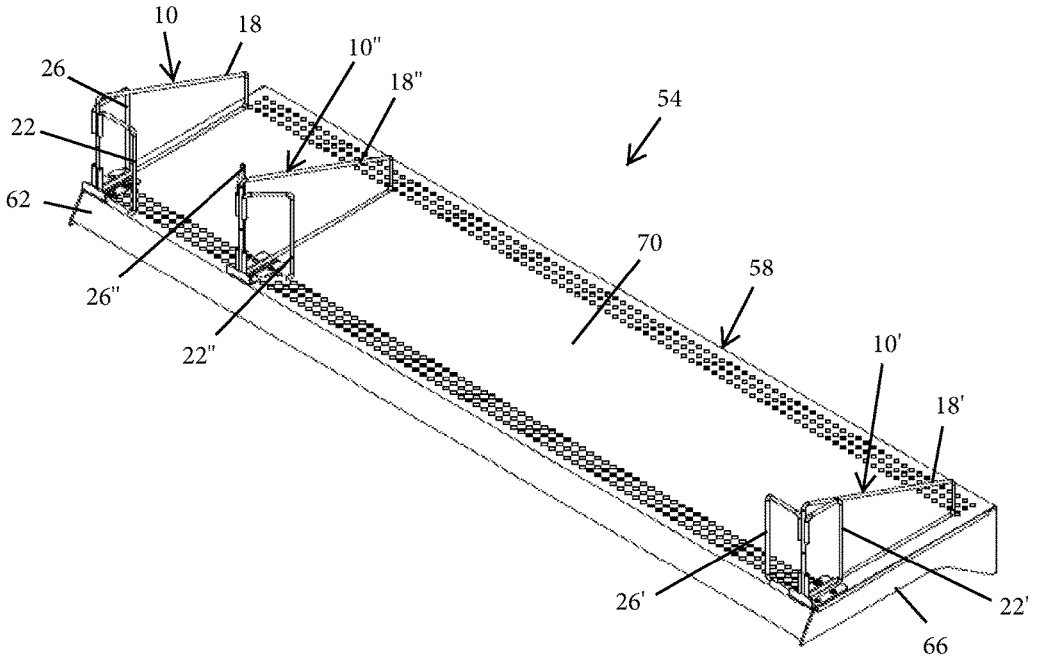
FIG. 19 is a perspective view of the shelving assembly, illustrating a third shelving divider.
Figure 20:
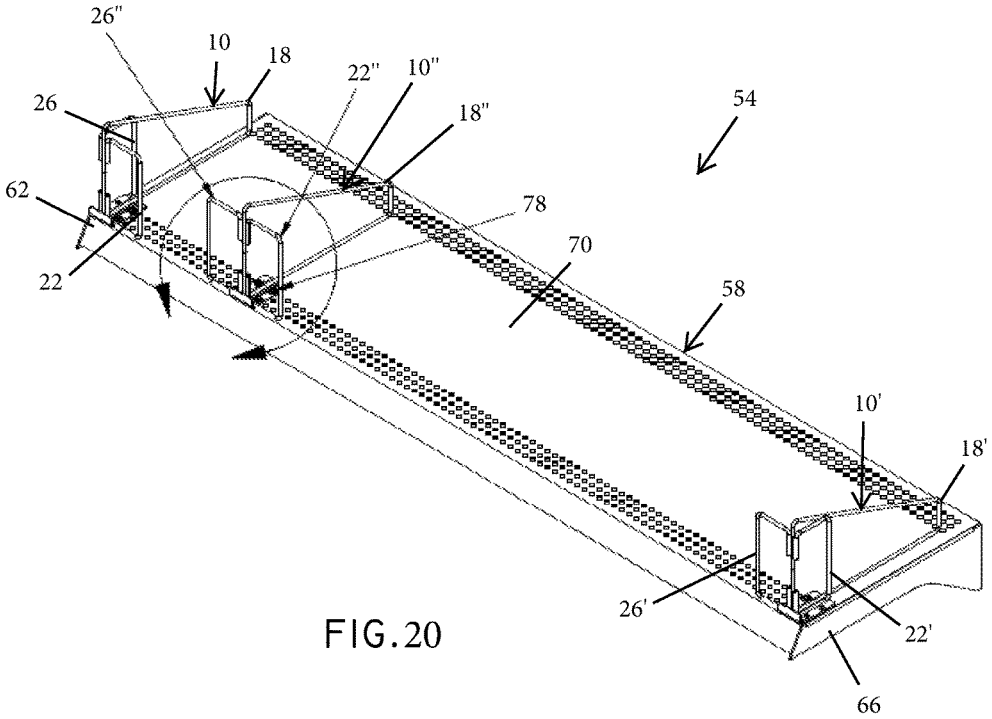
FIGS. 20 and 21 are perspective and enlarged perspective views, respectively, of an assembly process for coupling the third shelving divider to the shelf.
Figure 21:
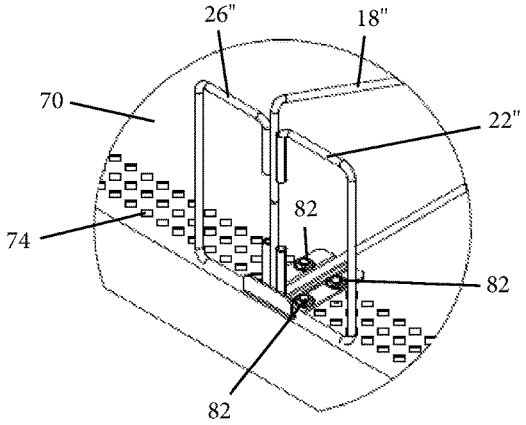

With reference to FIGS. 19-21, another one of the shelving dividers 10 (referenced as 10") may be coupled to the shelf 58 and used to divide the shelf 58 and the main shelf platform 70 into separate shelving spaces. To assemble the shelving divider 10' to the shelf 58, the first side arm 22" is rotated away from the center arm 18" until the first side arm 22" extends perpendicular to the center arm 18". The second side arm 26" is also rotated away from the center arm 18" until the second side arm 26" extends perpendicular to the center arm 18". The apertures 34" on the main body portion 30" of the base plate 14" are aligned with four of the apertures 74 on the main shelf platform 70 between the first and second ends 62, 66 of the shelf 58. Fasteners 78 (pins, screws, bolts, etc.) are then inserted through the apertures 34, 74 to lock (e.g., releasably lock) the shelving divider 10" to the shelf 58. As noted above, the fasteners 78 include heads 82. Once the fasteners 78 have been inserted through the apertures 34, 74, the heads 82 block rotation of the first side arm 22" back toward the center arm 18", and block rotation of the second side arm 26" back toward the center arm 18". Additionally, the raised lip 38 blocks rotation of both the first side arm 22" and the second side arm 26" further away from the center arm 18". Thus, once the fasteners 78 have been inserted, the first and second side arms 22", 26" are rotationally restrained, and as illustrated in FIGS. 20 and 21 the shelving divider 10 divides the shelf 58 and the main shelf platform 70 into separate shelving spaces.

Figure 22:
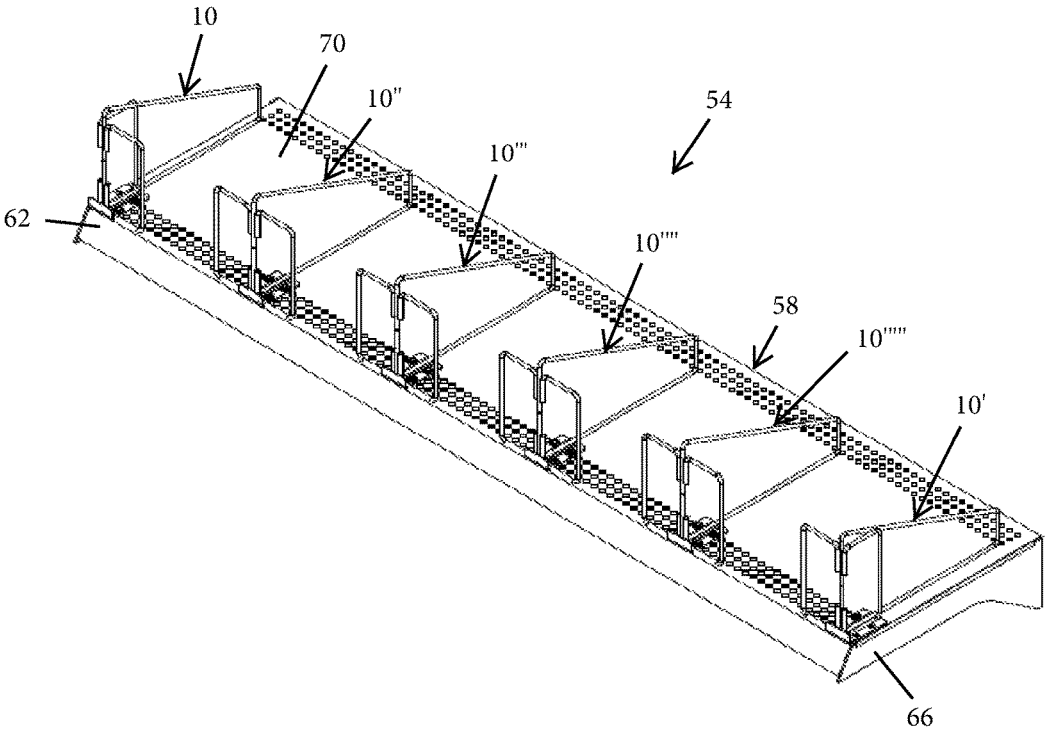
FIG. 22 is a perspective view of the shelving assembly, illustrating six shelving dividers coupled to the shelf.

The shelving assembly 54 may include a variety of different configurations. For example, in some embodiments the shelving assembly 54 may include only the single shelving divider 10 illustrated in FIG. 14, may include the two shelving dividers 10, 10' illustrated in FIG. 17, or may include the three shelving dividers 10, 10', 10" illustrated in FIG. 20. With reference to FIG. 22, in some embodiments the shelving assembly 54 may include six shelving dividers 10, 10', 10", 10''', 10'''', 10''''', two of which serve as shelf ends, and four of which divide the shelf 58 and the main shelf platform 70 into five separate shelving spaces. Other embodiments include various other numbers and arrangements of shelving dividers 10.

Although the disclosure has been described in detail with reference to certain preferred embodiments, variations and modifications exist within the scope and spirit of one or more independent aspects of the disclosure as described.

The invention claimed is:

1. A shelving divider comprising:

a base plate having a main body defining a plurality of apertures, and a raised lip extending from the main body;

a center arm coupled to the base plate;

a first side arm rotatably coupled to the center arm;

a second side arm rotatably coupled to the center arm;

at least one fastener configured to extend through at least one aperture of the plurality of apertures, wherein the fastener include a head, and wherein the head is configured to block rotation of at least one of the first side arm or the second side arm in at least one direction.

2. The shelving divider of claim 1, wherein the center arm is coupled to the base plate and disposed between at least two apertures of the plurality of apertures.

3. The shelving divider of claim 1, wherein the center arm is in the form of a wire frame.

4. The shelving divider of claim 1, wherein the center arm includes tubular connectors, wherein each connector receives an end of one of the first side arm or the second side arm.

5. The shelving divider of claim 1, wherein the first side arm is a wire frame.

6. The shelving divider of claim 5, wherein the second side arm is a wire frame.

7. The shelving divider of claim 1, wherein the first side arm is rotatable up to 90 degrees.

8. The shelving divider of claim 7, wherein the second side arm is rotatable up to 90 degrees relative to the center arm.

9. The shelving divider of claim 1, further comprising a plurality of fasteners configured to extend through the plurality of apertures, wherein the plurality of fasteners include heads, and wherein the heads are configured to block rotation of the first and second side arms in at least one direction.

10. The shelving divider of claim 1, wherein the center arm is configured to block rotation of the first side arm in at least one direction and the second side arm in at least one direction.

11. The shelving divider of claim 1, wherein the raised lip is configured to block rotation of the first side arm in at least one direction and the second side arms in at least one direction.

12. A shelving assembly comprising:

a shelf; and a shelving divider including:

a base plate having a main body defining a plurality of apertures, and a raised lip extending from the main body;

a center arm coupled to the base plate;

a first side arm rotatably coupled to the center arm;

a second side arm rotatably coupled to the center arm; and at least one fastener configured to extend through at least one aperture of the plurality of apertures, wherein the fastener include a head, and wherein the head is configured to block rotation of at least one of the first side arm or the second side arm in at least one direction, wherein the shelving divider is coupled to the shelf such that the first side arm extends perpendicular to the center arm and the second side arm extends parallel to the center arm.

13. The shelving assembly of claim 12, wherein the shelf includes a first end and a second, opposite end, wherein the shelving divider is coupled to the first end.

14. The shelving assembly of claim 13, wherein the shelving divider is a first shelving divider, wherein the shelving assembly includes a second shelving divider coupled to the second end of the shelf, wherein the second shelving divider includes a base plate having a main body defining a plurality of apertures, and a lip extending from the main body, a center arm coupled to the base plate, a first side arm rotatably coupled to the center arm, and a second side arm rotatably coupled to the center arm.

15. The shelving assembly of claim 14, wherein the second side arm of the second shelving divider extends perpendicular to the center arm of the second shelving divider, and the first side arm of the second shelving divider extends parallel to the center arm of the second shelving divider.

16. The shelving assembly of claim 15, further comprising a third shelving divider coupled to the shelf, wherein the third shelving divider includes a base plate having a main body defining a plurality of apertures, and a lip extending from the main body, a center arm coupled to the base plate, a first side arm rotatably coupled to the center arm, and a second side arm rotatably coupled to the center arm.

17. The shelving assembly of claim 16, wherein the third shelving divider is disposed between the first and second ends.

18. The shelving assembly of claim 16, wherein the first and second side arms of the third shelving divider each extend perpendicular to the center arm of the third shelving divider.

19. The shelving assembly of claim 18, wherein the shelf includes apertures that are aligned with the apertures of each of the first shelving divider, the second shelving divider, and the third shelving divider.

20. The shelving assembly of claim 19, further comprising a plurality of fasteners extending through the apertures of the first shelving divider, the second shelving divider, the third shelving divider, and the shelf.

21. A shelving divider comprising:

a base plate having a main body defining a plurality of apertures;

a center arm fixed to the base plate;

a first side arm rotatably coupled to the center arm;

a second side arm rotatably coupled to the center arm; and at least one fastener configured to extend through at least one aperture of the plurality of apertures, wherein the fastener include a head, and wherein the head is configured to block rotation of at least one of the first side arm or the second side arm in at least one direction, wherein the shelving divider is adjustable between a first configuration in which the first side arm extends perpendicular to the center arm and the second side arm extends parallel to the center arm, a second configuration in which the first side arm extends parallel to the center arm and the second side arm extends perpendicular to the center arm, and a third configuration where both the first and second side arms extend perpendicular to the center arm.

* * * * *